US007832799B2

(12) United States Patent
Davis, Jr. et al.

(10) Patent No.: US 7,832,799 B2
(45) Date of Patent: Nov. 16, 2010

(54) LOCKING SUPPORT ASSEMBLY FOR CASINO CHAIR

(75) Inventors: Wendell R. Davis, Jr., Reno, NV (US); Dale Robert Lundeen, Washoe Valley, NV (US); Kay Daniel Vetter, Reno, NV (US)

(73) Assignee: Gary Platt Manufacturing, LLC, Reno, NV (US)

( * ) Notice: Subject to any disclaimer, the term of this patent is extended or adjusted under 35 U.S.C. 154(b) by 21 days.

(21) Appl. No.: 12/354,686

(22) Filed: Jan. 15, 2009

(65) Prior Publication Data

US 2009/0179479 A1 Jul. 16, 2009

Related U.S. Application Data

(60) Provisional application No. 61/021,283, filed on Jan. 15, 2008.

(51) Int. Cl.
*A47C 7/62* (2006.01)
*A47B 83/02* (2006.01)

(52) U.S. Cl. ..... 297/217.7; 297/172; 297/174 R; 297/217.1; 297/463.1; 248/500; 248/501

(58) Field of Classification Search ..... 297/217.1, 297/217.7, 172, 174, 463.1, 174 R; 248/500, 248/501
See application file for complete search history.

(56) References Cited

U.S. PATENT DOCUMENTS 4,840,343 A 6/1989 Gasser
5,083,738 A 1/1992 Infanti
5,102,192 A 4/1992 Barile
5,114,112 A 5/1992 Infanti
5,176,437 A * 1/1993 Remington ..... 248/500 X
5,232,191 A 8/1993 Infanti
5,259,585 A 11/1993 Gregory
5,409,296 A 4/1995 Barile
5,522,641 A 6/1996 Infanti
5,542,748 A 8/1996 Barile
5,678,886 A 10/1997 Infanti
5,762,617 A 6/1998 Infanti
5,791,731 A 8/1998 Infanti
5,807,177 A 9/1998 Takemoto et al.
5,954,307 A * 9/1999 Williams ..... 248/501
6,227,614 B1 5/2001 Rubin
6,345,874 B2 * 2/2002 Duong et al. ..... 248/500 X (Continued)

*Primary Examiner*—Rodney B White
(74) *Attorney, Agent, or Firm*—Connolly Bove Lodge & Hutz LLP; Jonathan A. Jaech

(57) ABSTRACT

A locking support assembly for a casino chair uses a support plate with a chair mount having a fixed pin protruding upwards from the support plate opposite to the mount. The pin may serve as a sole or primary guide member in the support plate to guide the support plate into horizontal alignment with a latch mounted inside a beam. The beam holds the support plate in close but unlocked engagement by a lower groove, to resist loads imposed by an attached chair. A releasable latch inside the beam receives the pin to provide locked engagement between the support plate and the beam. The beam may be fastened to a vertical surface of a gaming machine or other object. The support plate and attached chair can be released from the beam by inserting a tool through a keyhole in the beam to release the latch, while pulling the support plate outwards.

27 Claims, 6 Drawing Sheets

U.S. PATENT DOCUMENTS

| | | | | |
|---|---|---|---|---|
| 6,354,660 | B1 | 3/2002 | Friedrich | |
| 6,502,800 | B1 | 1/2003 | Ursini et al. | |
| 6,533,238 | B2 * | 3/2003 | Barnes et al. | 248/680 |
| 6,572,187 | B2 | 6/2003 | Laufer | |
| 7,240,889 | B2 * | 7/2007 | Giovinazzi | 248/501 |
| D559,328 | S | 1/2008 | Rasmussen et al. | |
| 7,396,084 | B2 * | 7/2008 | Staab et al. | 297/463.1 |
| 7,407,228 | B1 | 8/2008 | Infanti | |
| 7,625,042 | B2 * | 12/2009 | Friedrich | 297/172 X |
| 7,658,445 | B2 * | 2/2010 | Mittler et al. | 297/217.7 X |
| 2008/0039215 | A1 | 2/2008 | Hahn | |
| 2008/0136228 | A1 | 6/2008 | Friedrich | |
| 2008/0246321 | A1 | 10/2008 | Canterbury | |

* cited by examiner

LOCKING SUPPORT ASSEMBLY FOR CASINO CHAIR

CROSS-REFERENCE TO RELATED APPLICATION

This application claims priority pursuant to 35 U.S.C. §119 (e) to U.S. provisional application Ser. No. 61/021,283, filed Jan. 15, 2008, which application is specifically incorporated herein, in its entirety, by reference.

BACKGROUND

1. Field

The present disclosure relates to locking support assemblies for supporting casino chairs and locking such chairs to gaming machines or other fixed locations.

2. Description of Related Art

Casino operators often desire chairs for gaming machines, such as, for example, slot machines, to be attached to the machine or to a location adjacent to the machine. This promotes a more orderly and safer casino by preventing inappropriate use or movement of casino chairs. Many jurisdictions require casino operators to use fixed or attached chairs. At the same time, casino chairs are expected to be both comfortable and exceptionally durable, maintaining an attractive appearance despite heavy, continuous use. Such fixed casino chairs are indeed constructed with heavy-duty materials and are quite durable, but must nonetheless be removed from their fixed locations from time-to-time, to facilitate relocating or servicing the gaming machines and maintenance or repair of the chair or adjacent facilities.

Various chair support assemblies therefore have been developed to attach a casino chair to a gaming machine in a removable fashion. One such assembly 100 is shown in FIG. 1. A casino chair 102 may thereby be readily fixed relative to the gaming machine, and easily relocated with it. Such support assemblies may use a floorplate 104 (sometimes referred to as a "sled") running between a column support 106 for the chair and a stabilizing bracket 108 that is attached to the base of the gaming machine. The stabilizing bracket may be fixed to the sled and attached to the gaming machine using conventional fasteners, for example, machine screws or bolts. Besides attaching the chair 102 to a game machine, the bracket 108 resists pitching forces, as indicated by arrow 101, and yawing forces as indicated by arrow 103. Twisting forces around the column 106 axis are generally minimal for swiveling chairs as commonly used in the industry.

To facilitate removal and reassembly of the sled from the gaming machine without requiring removal or installation of screw-type fasteners, various assemblies in which the sled and bracket are joined using various screwless locks have been developed. These sled/bracket assemblies are available in two general types: non-locking assemblies and locking assemblies.

Non-locking assemblies often use an upturned lip or flange along the leading edge of the sled distal from the chair column to engage with a complementary downturned flange along the stabilizing bracket. The bracket may be attached to the gaming machine using screws, bolts, or other fasteners. To engage the floorplate and chair, the chair is lifted to cause the floorplate to pivot upwards around its leading edge, thereby tilting the upturned flange downwards until it can be inserted under the downturned flange of the bracket. The chair can then be lowered to engage the opposing flanges and thereby secure the floorplate into position.

Locking assemblies provide the additional security of a specially shaped key to disengage the floorplate from the stabilizing bracket, preventing unauthorized removal. Prior art locking assemblies include those that use a vertically sliding latch, or a rotating pawl, housed in the stabilizing bracket to engage with a receiving surface of the floor plate. Actuation of the latch or pawl using a special tool or key is required to disengage the floorplate from the bracket. The floorplate may then be removed from the bracket by pulling outward while the latch is retracted, thereby pulling the floorplate out of engagement with latch or pawl. Depending on the design, lifting of the chair to tilt the floorplate may also be required. Locking occurs when the floorplate is slid into position into the bracket until the operation of a spring forces the vertical sliding latch or the protruding arm of the rotating pawl against the receiving surface of the floorplate.

Notwithstanding the advantages of prior art locking and non-locking support assemblies, they are subject to certain disadvantages. Locking assemblies generally require precise alignment between the latch mechanisms in the bracket and the receiving surfaces in the floorplate, but are not structured to facilitate quick and easy alignment of the locking surfaces while handling the casino chair and support plate. In addition, some prior art designs require pulling and/or tilting the floorplate while simultaneously operating a key, making removal of the floorplate more cumbersome than desired. It is desirable, therefore, to overcome these and other limitations of the prior art by providing an improved locking support assembly for a casino chair.

SUMMARY

A locking support assembly for a chair uses generally planar support plate having a receiver for a chair, such as a pattern of mounting holes or brackets, disposed at an upper surface of the support plate. The support plate further includes a fixed pin disposed adjacent to a leading edge of the support plate distal from the receiver for a chair column, and protrudes vertically upwards from the upper surface of the plate at or near the midpoint of the leading edge. In turn, the midpoint of the leading edge lies on a central axis of the support plate, which runs through a load centroid of the chair receiver. The pin, which may be a cylindrical metal pin, functions as a latch hold for a corresponding latch mechanism that is disposed in a latch block. The latch block may perform functions performed by the stabilizing bracket in prior art designs, and may also be referred to herein as a beam.

The latch block or beam comprises a sturdy metal piece that is configured for attaching to the base of a game machine or to an independent base or stand attached to the game machine, using the fasteners of the like, and for locking the support plate in place via operation of the latch mechanism. The beam includes a lower channel running horizontally the length of the beam, which is generally about the length of the leading edge of the support plate. The lower channel encloses the leading edge of the support plate, thereby holding the support plate between opposing walls of the lower channel. When the support plate is held in place by the latch, torsion on the support plate by the chair is primarily borne by the beam at its lower channel, and not by the centrally-located vertical pin of the support plate or the latch mechanism disposed in the beam. The latch and pin serve to retain the support plate in the lower channel of the beam, but are not loaded by normal use of the chair.

The beam also includes an upper chamber or channel disposed above the lower channel, housing the latch mechanism. A slot is cut into an outer wall of the upper channel towards the support plate, to admit the vertical pin into the latch mechanism. The latch mechanism is positioned horizontally to receive the vertical pin, and is configured such that when the pin is impelled against a receiving surface of the latch mechanism by inward movement of the support plate into the lower channel of the beam, the latch mechanism works against a spring to admit the pin inward until the pin clears the latch mechanism, which once cleared by the pin, is impelled horizontally back by the spring to a position preventing the pin from being withdrawn from the latch mechanism, thus providing locked engagement between the support plate and the beam.

Advantageously, the horizontal action of the latch block against the vertical cylindrical pin of the support plate reduces the risk of sticking in the latch. Also, tapered guide surfaces in the beam guide the pin to the latch mechanism while the support plate is inserted in the latch block, facilitating rapid latching and eliminating seek time for the latch point. Use of a single, centrally-disposed vertical, or substantially vertical, pin and complementary latch for the locking function, also helps reduce seek time. In addition, the centrally-disposed location of the latch mechanism and pin relative to the center of load imposed by the chair should minimize or eliminate cyclical loads on the latch and pin caused by use of the chair, causing torsion loads to be borne as compressive loading on the walls of the lower channel. The present combination of channel and latch should thus enhance the ease of use, reliability and durability of the support assembly as compared to prior lockable support assemblies.

To unlock the support plate from the beam, a key may be inserted through a key hole in the beam chamber wall to depress a release lever of the latch mechanism. Once the latch is released, the support plate may be withdrawn from the lower channel to remove the support plate and chair from the latch block.

A more complete understanding of the locking support assembly for a casino chair will be afforded to those skilled in the art, as well as a realization of additional advantages and objects thereof, by a consideration of the following detailed description. Reference will be made to the appended sheets of drawings which will first be described briefly.

DETAILED DESCRIPTION

In the detailed description that follows, like element numerals are used to indicate like elements appearing in the figures.

Figure 1:
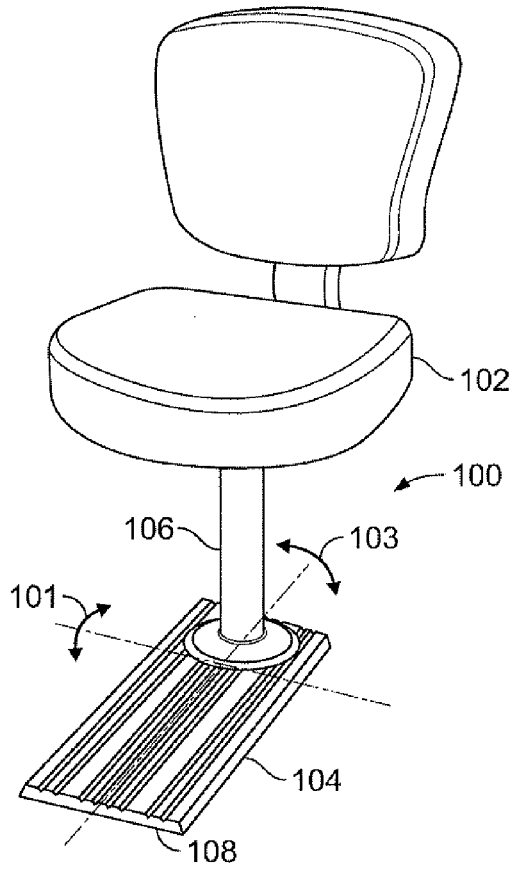
FIG. 1 (Prior Art)
FIG. 1 is a view of a prior-art support assembly and casino chair using screw-type fasteners to attach the stabilizing bracket to the gaming machine.
Figure 2:
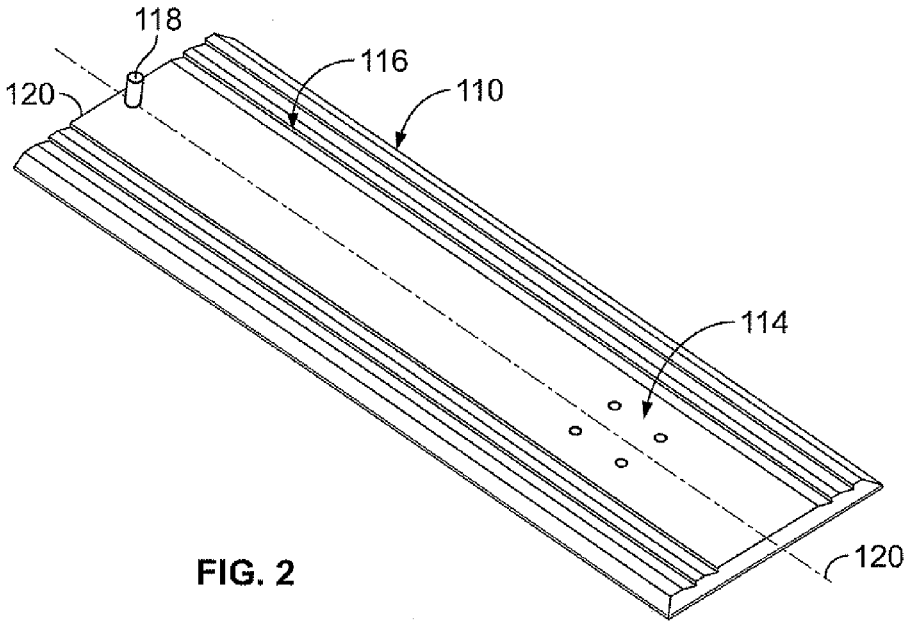
FIG. 2 is an isometric view of an exemplary support plate for use in the present chair support assembly.
Figure 3:
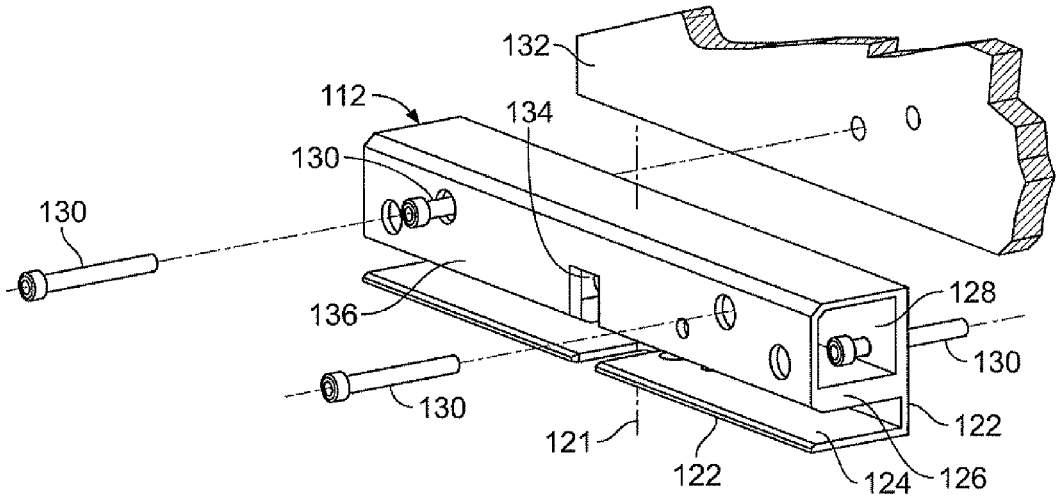
FIG. 3 is an isometric view of an exemplary latch block for use in the present chair support assembly, and attachment to a gaming machine base.
Figure 4:
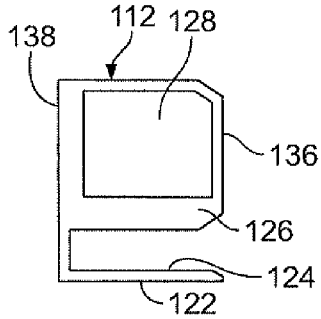
FIG. 4 is an end view of the latch block shown in FIG. 3.
Figure 5:
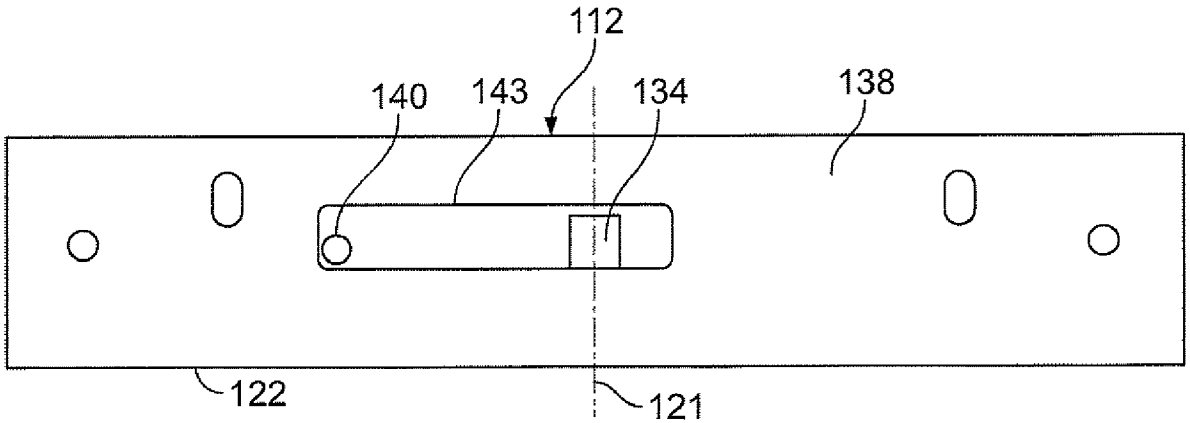
FIG. 5 is a rear view of the latch block shown in FIG. 3.
Figure 6:
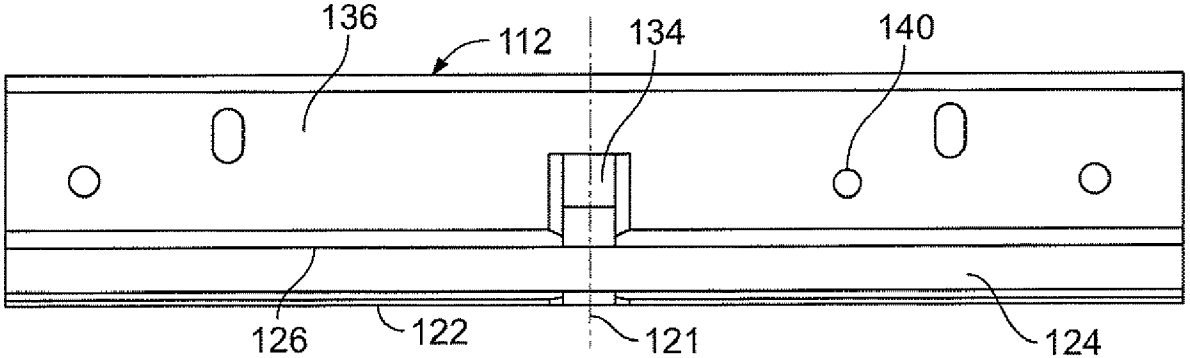
FIG. 6 is a front view of the latch block shown in FIG. 3.

A locking support assembly for a casino chair comprises a support plate 110 as shown in FIG. 2, coupled to a beam 112, also called a latch block, as shown in FIGS. 3-6. The support plate 110 may comprise a generally planar rectangular piece of aluminum, steel or other durable material, having a receiver 114 for a chair disposed at an upper surface 116 of thereof. The plate may be machined out of extruded or other stock material. The receiver may comprise a pattern of mounting holes, as shown, or any other suitable structure for mounting a chair column to the support plate. The support plate may be eight to thirty-six inches in width and 0.2 to 1.0 inches thick, depending on the choice of materials, number of chairs supported, plate configuration, length and desired appearance. In an exemplary embodiment, the support plate comprised a solid aluminum member approximately 11 inches wide, 0.38 inches thick and three feet long.

Support plate 110 may further comprise a pin 118 fixed to the support plate and protruding upwards therefrom, the pin disposed adjacent to a leading edge 120 of the support plate distal from the receiver 114 for a chair column. The pin may comprise a generally cylindrical member, such as, for example, a cylindrical steel pin, and may be beveled or rounded around its upper perimeter. The pin may protrude at a right angle to the upper surface 116 of the support plate, such that the pin is vertical, or substantially vertical, when the support plate is resting on a horizontal floor. Advantageously, the pin 118 and the receiver 114 may be disposed along a central longitudinal axis 120 of the support plate, while the support plate is laterally symmetric around the axis 120. In addition, the leading edge 120 and adjacent region of the support plate may be smooth and substantially free of any protrusion except for the single pin 118, such that the pin 118 is the sole latching member for the support plate. The support plate may also be free of any member disposed for guiding the support plate into horizontal alignment with the latch, except for the pin. The pin may thereby be configured to function both as the sole guide member, and sole latch member, for joining the support plate to the latch block.

Referring to FIGS. 3-6, the latch block 112 may comprise a beam formed of aluminum, steel or other durable material. For example, the latch block may comprise an extruded aluminum beam into which the other features as described herein are machined. A bottom wall or web 122 of the beam forms a lower wall of a lower channel 124. The lower wall may be designed to rest on a floor surface. The lower channel is configured to enclose the support plate at and near its leading edge, so that support plate is held between the lower wall 122 and an opposing middle wall 126. In the depicted embodiment, the lower channel 124 and its walls are arranged symmetrically around a central axis 121 of the beam, and extend for at least substantially the length of the leading edge of the support plate. The lower channel may be configured to mate with the support plate in a clearance fit, with the middle wall 126 above the upper surface 116 of the support plate, and the opposing lower surface of the support plate resting on the lower wall 122.

The middle wall 126 may also function as a lower wall of an upper channel 128 in the beam 122. The upper channel functions to enclose a latch mechanism for the vertical pin of the support plate, protecting the latch from foot traffic, dirt, and unauthorized releasing of the latch. The upper channel also hides and protects fasteners 130 used to fasten the latch block 112 to a gaming machine base 132. While the depicted embodiment shows the upper channel extending the entire length of the beam, in alternative embodiments the upper channel or chamber may extend less than the entire length of the beam, and may be disposed around or adjacent to the central axis 121 to enclose the latch mechanism. In addition, in alternative embodiments the upper channel may be omitted entirely and a separate housing (not shown) be used to enclose and protect the latch mechanism.

Conversely, the lower channel should, in alternative embodiments, extend for at least a substantial portion of the beam length, for example, at least 30% of total length. If any portion of the lower channel is omitted, whatever portions of the lower channel that are included should be positioned distally from the central axis 121 to better resist torque loads imposed by the support plate.

The latch block 112 may further comprise an opening 134 disposed centrally around axis 121 in front side wall 136 to admit the vertical pin into the upper channel. The side wall 136 may be rounded or beveled around the opening 134 to better guide the pin into the upper channel, where it can engage with the latch assembly. A circular keyhole 140 may be formed in the front side wall 136 to admit a key into the upper channel, enabling release of the latch mechanism. A rear opening 143 may be formed in the rear wall 138 of the latch block to facilitate assembly of the latch mechanism in the upper channel. The real wall 138 may be configured to abut a game machine base, to which the latch block may be affixed using any suitable fasteners 130, such as, for example, machine screws. Front wall 136 and rear wall 138 may include various through holes as shown in FIGS. 3-6, to accommodate such fasteners.

Figure 7A:
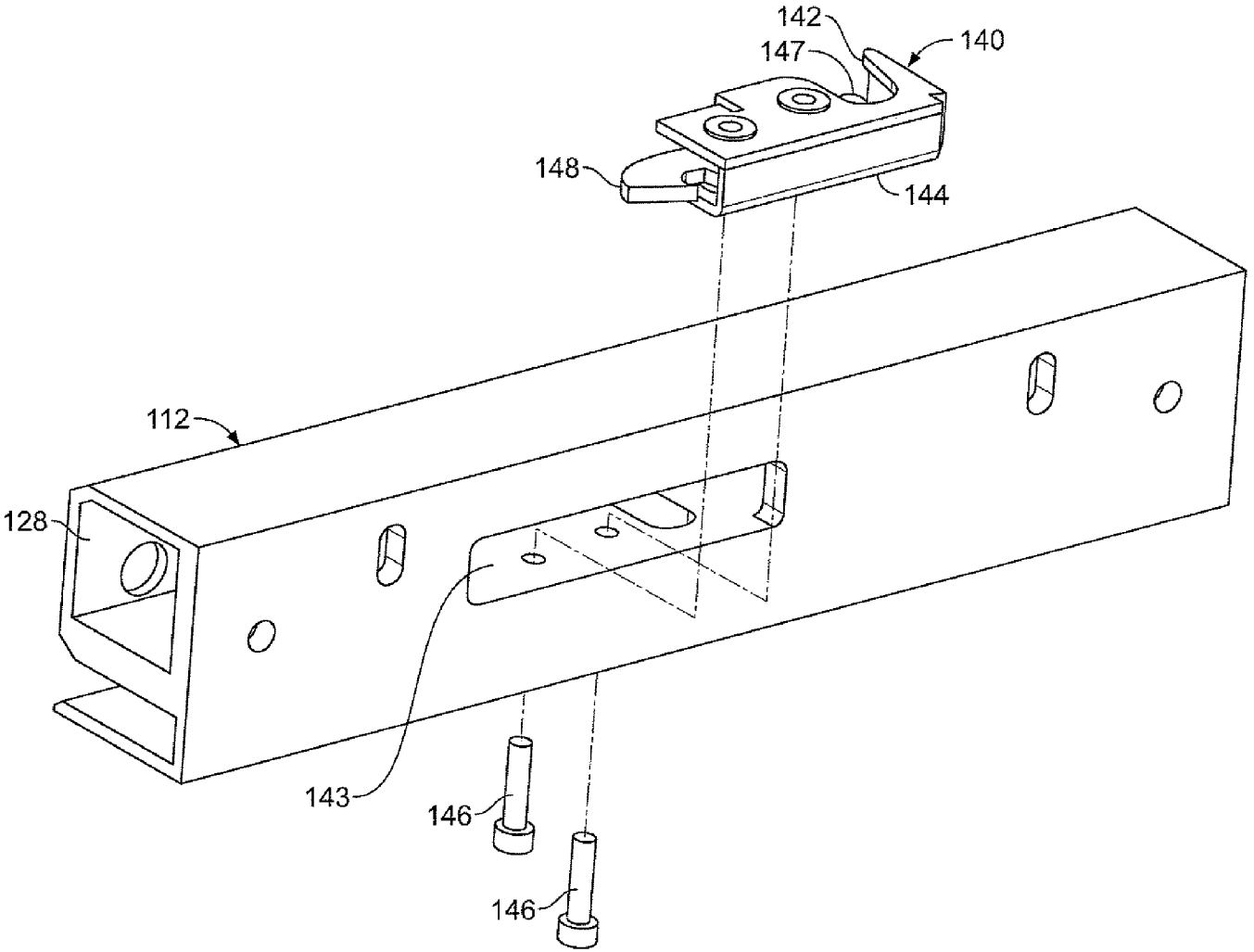
FIG. 7A is an isometric exploded view of the latch block shown in FIG. 3, showing assembly of a latch mechanism inside the beam.
Figure 7B:
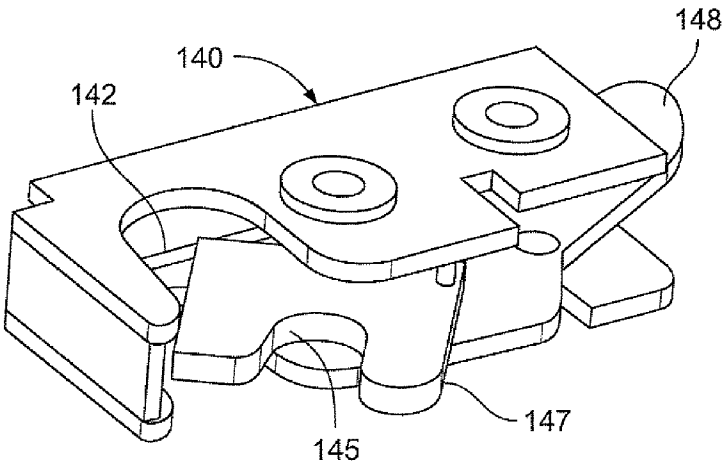
FIG. 7B is an isometric view of the latch mechanism, from a different angle.

Referring to FIGS. 7A and 7B, a latch mechanism 140 may be positioned in an interior of the upper channel 128, and fastened to the middle wall 126 using any suitable fastener 146. Latch mechanism 140 may comprise a mini rotary two-stage latch as commonly used for cabinet door latches or the like, for example a rotary two-stage latch with a maximum holding force of 750 pounds. The latch mechanism may be configured such that when the pin 118 of the support plate is impelled against a receiving surface 145 of the latch mechanism by inward movement of the support plate into the lower channel, the latch mechanism works a spring to admit the pin inward. The latch may admit the pin inward until the leading edge of the support plate closely approaches a back wall of the lower channel, at which point the pin progresses past a trigger point of the latch mechanism. Progression of the pin past the trigger point causes the latch mechanism locking arm 147 to be driven horizontally around a vertical axis bringing the latch to a spring-loaded locked position. The vertical pin is thereby held by the horizontal latch, providing locked engagement between the support plate and the beam. The axis of engagement runs through the vertical pin and central axis of the support plate, minimizing stresses imposed on the latch by use an attached casino chair.

A release lever 148 may be coupled to the latch mechanism, such that actuation of the release lever by a key inserted via the keyhole 140 into the upper channel releases the latch mechanism, enabling withdrawal of the pin from the latch mechanism. The latch may be configured such that horizontal inward movement of the release lever releases the latch mechanism horizontally outward, enabling withdrawal of the pin from the latch mechanism.

A guide 142 may be positioned in the interior of the upper channel, the guide comprising opposing surfaces converging towards the receiving surface of the latch mechanism to guide the pin into a locked position. In the depicted embodiment, the guide 142 is formed as part of a housing 144 for the latch mechanism. In the alternative, or in addition, the guide may comprise part of the beam 122 or may be a separate component mounted in the interior of the upper channel 128 or lower channel 124. In the depicted embodiment, the rounded surface of the slot 134 are aligned with the guide surfaces of guide 142 positioned around the receiving surface of the latch mechanism, so as to form an integrated guide for guiding the pin into the latch. Therefore, the support plate may easily be inserted into the latch block by aligning the pin with the slot 134, whereupon pushing the support plate inwards causes the pin to be captured by the guide and thereby guided to a latched position.

Figure 9:
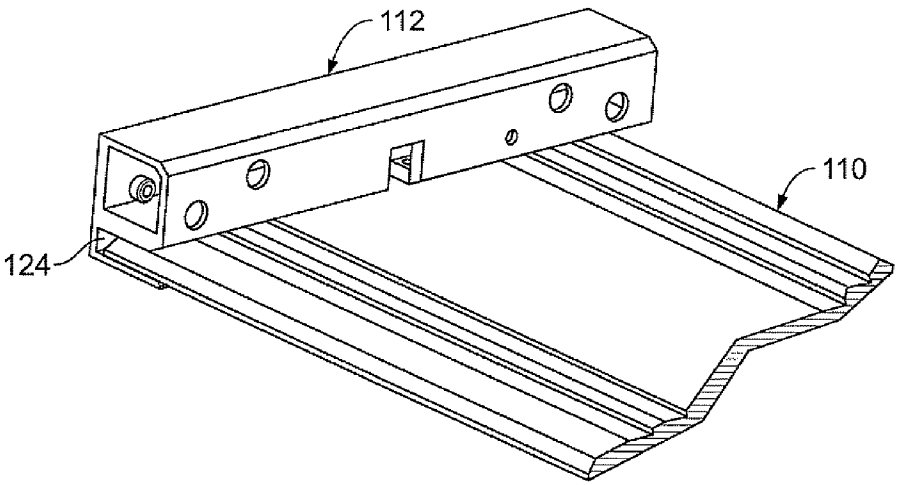
FIG. 9 is an isometric view of the locking support assembly for a casino chair, showing the support plate held by the latch block and latched in place.
Figure 8:
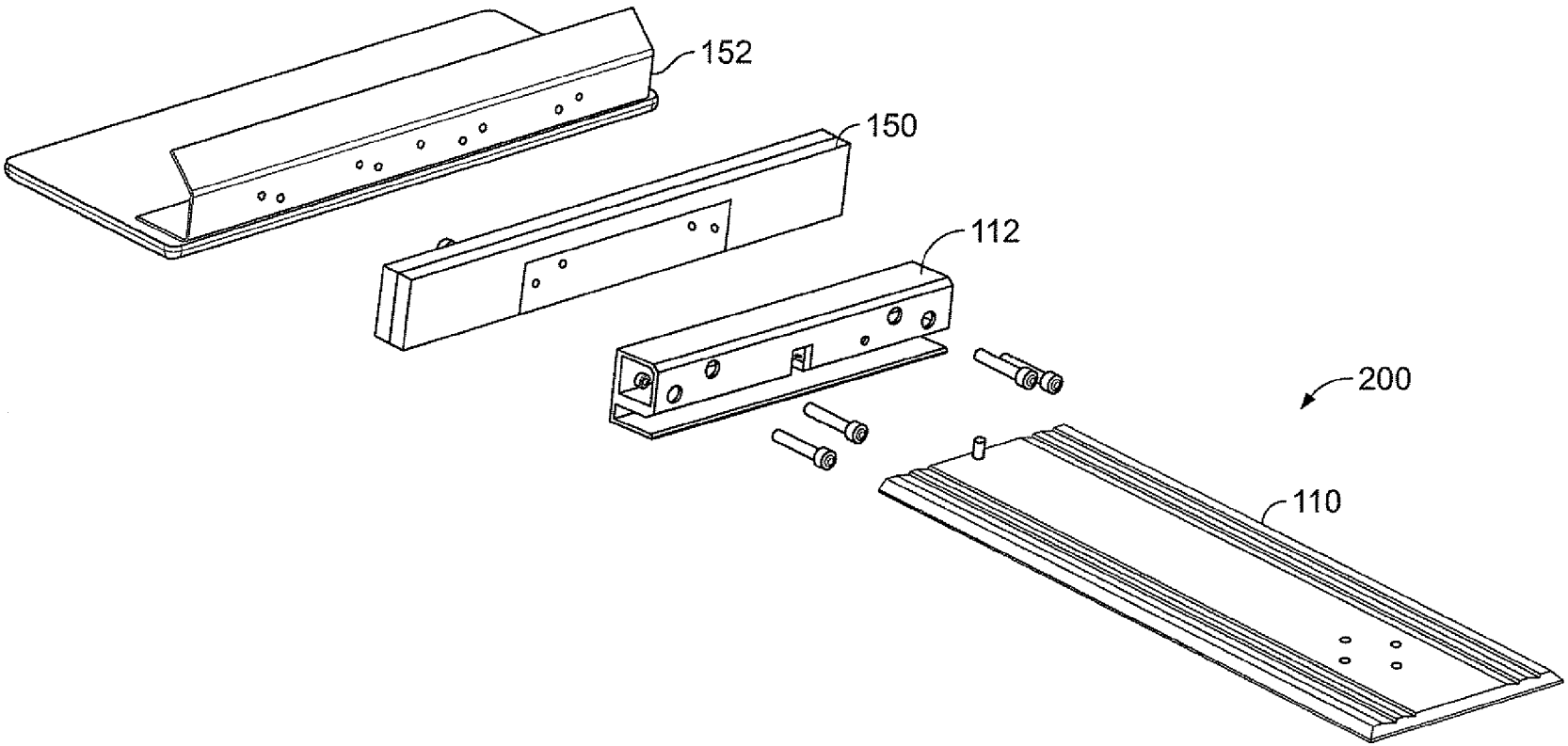
FIG. 8 is an exploded assembly view showing the components of the support assembly and attachment to a machine base.

FIG. 8 shows an exemplary locking support assembly 200 for a casino chair, in an exploded assembly view. The support plate 110 and guide/lock pin 118 are aligned for insertion in the latch block 112, as previously described. The latch block 112 may be attached to the base of a wooden or composite cabinet of a gaming machine 150 using T-nuts. In the alternative, the latch block may be attached to an integrated metal bracket 152 attached to a gaming machine base or stand. FIG. 9 shows the support plate 110 inserted and fully engaged in the lower channel 124 of the latch block. The depth of engagement in the lower channel may be about 1 to 10 times the thickness of the support plate. In the depicted embodiment, the lower channel is about 1.6 inches deep and fully engages the support plate which is about 0.38 inches thick. When fully engaged, the leading edge of the support plate contacts the back wall of the lower channel. When inserting the support plate into the channel, the pin should trigger the locking action of the latch just before becoming fully engaged. To remove the support plate, the latch may be released using a key, after which the support plate may be pulled out of the latch block.

Having thus described a preferred embodiment of locking support assembly for a casino chair, it should be apparent to those skilled in the art that certain advantages of the within system have been achieved. It should also be appreciated that various modifications, adaptations, and alternative embodiments thereof may be made without departing from the scope and spirit of the present technology. The following claims define the scope of what is claimed.

What is claimed is:

1. A locking support assembly for a chair, comprising:

a generally planar support plate having a receiver for a chair disposed at an upper surface of the support plate;

a pin fixed to the support plate and protruding upwards therefrom, the pin disposed adjacent to a leading edge of the support plate distal from the receiver for a chair column;

a beam enclosing the leading edge of the support plate in a lower channel of the beam, the beam holding the support plate between opposing walls of the lower channel, the beam further comprising walls of an upper channel disposed above the lower channel;

a latch mechanism positioned in an interior of the upper channel, the latch mechanism configured such that when the pin is impelled against a receiving surface of the latch mechanism by inward movement of the support plate into the lower channel, the latch mechanism works a spring to admit the pin inward until the pin progresses past a trigger point of the latch mechanism, releasing the latch mechanism to be driven horizontally by the spring to a locked position and thus providing locked engagement between the support plate and the beam; and a release lever coupled to the latch mechanism, such that horizontal inward movement of the release lever releases the latch mechanism horizontally outward, enabling withdrawal of the pin from the latch mechanism.

2. The support assembly of claim 1, further comprising a guide positioned in the interior of the upper channel, the guide comprising opposing surfaces converging towards the receiving surface of the latch mechanism to guide the pin into a locked position.

3. The support assembly of claim 1, wherein the latch mechanism pivots around an axis generally perpendicular to the upper surface of the support plate when impelled upon by the pin.

4. The support assembly of claim 1, wherein the pin is generally cylindrical.

5. The support assembly of claim 1, wherein the pin and the receiver are disposed along a central longitudinal axis of the support plate.

6. A locking support assembly for a chair, comprising:

a generally planar support plate having a receiver for a chair disposed at an upper surface of the support plate;

a pin fixed to the support plate and protruding upwards therefrom, the pin disposed adjacent to a leading edge of the support plate distal from the receiver for a chair column;

a beam enclosing the leading edge of the support plate in a lower channel of the beam, the beam holding the support plate between opposing walls of the lower channel, the beam further comprising walls of an upper channel disposed above the lower channel;

a latch mechanism positioned in an interior of the upper channel, the latch mechanism configured such that when the pin is impelled against a receiving surface of the latch mechanism by inward movement of the support plate into the lower channel, the latch mechanism works a spring to admit the pin inward until the pin progresses past a trigger point of the latch mechanism, releasing the latch mechanism to be driven horizontally by the spring to a locked position and thus providing locked engagement between the support plate and the beam; and a release lever coupled to the latch mechanism, such that actuation of the release lever by a key inserted into the upper channel releases the latch mechanism, enabling withdrawal of the pin from the latch mechanism.

7. The support assembly of claim 6, further comprising an opening in a wall of the upper channel, disposed to admit the key for actuating the release lever.

8. The support assembly of claim 6, further comprising a guide positioned in the interior of the upper channel, the guide comprising opposing surfaces converging towards the receiving surface of the latch mechanism to guide the pin into a locked position.

9. The support assembly of claim 6, wherein the latch mechanism pivots around an axis generally perpendicular to the upper surface of the support plate when impelled upon by the pin.

10. The support assembly of claim 6, wherein the pin is generally cylindrical.

11. The support assembly of claim 6, wherein the pin and the receiver are disposed along a central longitudinal axis of the support plate.

12. A locking support assembly for a chair, comprising:

a generally planar support plate having a receiver for a chair disposed at an upper surface of the support plate;

a pin fixed to the support plate and protruding upwards therefrom, the pin disposed adjacent to a leading edge of the support plate distal from the receiver for a chair column;

a beam enclosing the leading edge of the support plate in a lower channel of the beam, the beam holding the support plate between opposing walls of the lower channel, the beam further comprising walls of an upper channel disposed above the lower channel; and a latch mechanism positioned in an interior of the upper channel, the latch mechanism configured such that when the pin is impelled against a receiving surface of the latch mechanism by inward movement of the support plate into the lower channel, the latch mechanism works a spring to admit the pin inward until the pin progresses past a trigger point of the latch mechanism, releasing the latch mechanism to be driven horizontally by the spring to a locked position and thus providing locked engagement between the support plate and the beam, wherein the leading edge of the support plate is smooth and substantially free of any protrusion except for the pin, and wherein the support plate is free of any member disposed for guiding the support plate into horizontal alignment with the latch mechanism, except for the pin.

13. The support assembly of claim 12, wherein the beam is integrated with a guide positioned around the receiving surface of the latch mechanism for guiding the pin to the latch mechanism.

14. The support assembly of claim 12, further comprising a guide positioned in the interior of the upper channel, the guide comprising opposing surfaces converging towards the receiving surface of the latch mechanism to guide the pin into a locked position.

15. The support assembly of claim 12, wherein the latch mechanism pivots around an axis generally perpendicular to the upper surface of the support plate when impelled upon by the pin.

16. The support assembly of claim 12, wherein the pin is generally cylindrical.

17. The support assembly of claim 12, wherein the pin and the receiver are disposed along a central longitudinal axis of the support plate.

18. A locking support assembly for a chair, comprising:

a generally planar support plate having a receiver for a chair disposed at an upper surface of the support plate;

a pin fixed to the support plate and protruding upwards therefrom, the pin disposed adjacent to a leading edge of the support plate distal from the receiver for a chair column;

a beam enclosing the leading edge of the support plate in a lower channel of the beam, the beam holding the support plate between opposing walls of the lower channel, the beam further comprising walls of an upper channel disposed above the lower channel; and a latch mechanism positioned in an interior of the upper channel, the latch mechanism configured such that when the pin is impelled against a receiving surface of the latch mechanism by inward movement of the support plate into the lower channel, the latch mechanism works a spring to admit the pin inward until the pin progresses past a trigger point of the latch mechanism, releasing the latch mechanism to be driven horizontally by the spring to a locked position and thus providing locked engagement between the support plate and the beam, wherein the upper channel is generally enclosed and a wall thereof includes an opening positioned to receive the pin into the interior of the upper channel.

19. The support assembly of claim 18, further comprising a guide positioned in the interior of the upper channel, the guide comprising opposing surfaces converging towards the receiving surface of the latch mechanism to guide the pin into a locked position.

20. The support assembly of claim 18, wherein the latch mechanism pivots around an axis generally perpendicular to the upper surface of the support plate when impelled upon by the pin.

21. The support assembly of claim 18, wherein the pin is generally cylindrical.

22. The support assembly of claim 18, wherein the pin and the receiver are disposed along a central longitudinal axis of the support plate.

23. A locking support assembly for a chair, comprising:

a generally planar support plate having a receiver for a chair disposed at an upper surface of the support plate;

a pin fixed to the support plate and protruding upwards therefrom, the pin disposed adjacent to a leading edge of the support plate distal from the receiver for a chair column;

a beam enclosing the leading edge of the support plate in a lower channel of the beam, the beam holding the support plate between opposing walls of the lower channel, the beam further comprising walls of an upper channel disposed above the lower channel; and a latch mechanism positioned in an interior of the upper channel, the latch mechanism configured such that when the pin is impelled against a receiving surface of the latch mechanism by inward movement of the support plate into the lower channel, the latch mechanism works a spring to admit the pin inward until the pin progresses past a trigger point of the latch mechanism, releasing the latch mechanism to be driven horizontally by the spring to a locked position and thus providing locked engagement between the support plate and the beam, wherein the beam further comprises a mounting surface configured to mount to a vertical wall, the mounting surface disposed on a first exterior wall of the upper channel facing away from the support plate, and accessible through openings in a second exterior wall of the upper channel facing towards the support plate.

24. The support assembly of claim 23, further comprising a guide positioned in the interior of the upper channel, the guide comprising opposing surfaces converging towards the receiving surface of the latch mechanism to guide the pin into a locked position.

25. The support assembly of claim 23, wherein the latch mechanism pivots around an axis generally perpendicular to the upper surface of the support plate when impelled upon by the pin.

26. The support assembly of claim 23, wherein the pin is generally cylindrical.

27. The support assembly of claim 23, wherein the pin and the receiver are disposed along a central longitudinal axis of the support plate.

* * * * *